US006135804A

United States Patent [19]

Lux

[11] Patent Number: 6,135,804

[45] Date of Patent: Oct. 24, 2000

[54] ELECTRICAL CONNECTOR ASSEMBLY INCLUDING INSULATION PIERCING PLUG-IN MEANS

[75] Inventor: Solveig Lux, Schaafheim-Mosbach, Germany

[73] Assignee: Weidmuller Interface GmbH & Co., Detmold, Germany

[21] Appl. No.: 09/189,849

[22] Filed: Nov. 12, 1998

[30] Foreign Application Priority Data

Dec. 3, 1997 [DE] Germany ..... 297 21 354 U

[51] Int. Cl.[7] ..... H01R 4/24; H01R 4/26; H01R 11/20

[52] U.S. Cl. ..... 439/397; 439/398

[58] Field of Search ..... 439/387–413, 439/212, 213

[56] References Cited

U.S. PATENT DOCUMENTS

| | | | |
|---|---|---|---|
| 4,235,502 | 11/1980 | Marks et al. | 439/557 |
| 4,405,193 | 9/1983 | Weidler | 439/398 |
| 4,448,467 | 5/1984 | Weidler | 439/80 |
| 4,449,767 | 5/1984 | Weidler | 439/64 |
| 5,213,518 | 5/1993 | Weidler | 439/211 |

FOREIGN PATENT DOCUMENTS 196 28 116 C1 10/1997 Germany .

*Primary Examiner*—Brian Sircus
*Assistant Examiner*—Michael C. Zarroli
*Attorney, Agent, or Firm*—Laubscher & Laubscher

[57] ABSTRACT

An electrical connector assembly includes a main connector body formed of insulating material and containing a longitudinal through bore, an electrical contact having an insulation-piercing cutting edge mounted in a slot contained in the rear end of the connector body, and a wire support member having a forward end portion that is insertable within the slot, the support member forward end containing on its lateral surface a vertical groove for receiving an insulated wire conductor, whereby when the support member forward end is inserted within the slot, the cutting edge pierces the wire insulation and engages the electrical conductor at a desired location intermediate its ends.

12 Claims, 5 Drawing Sheets

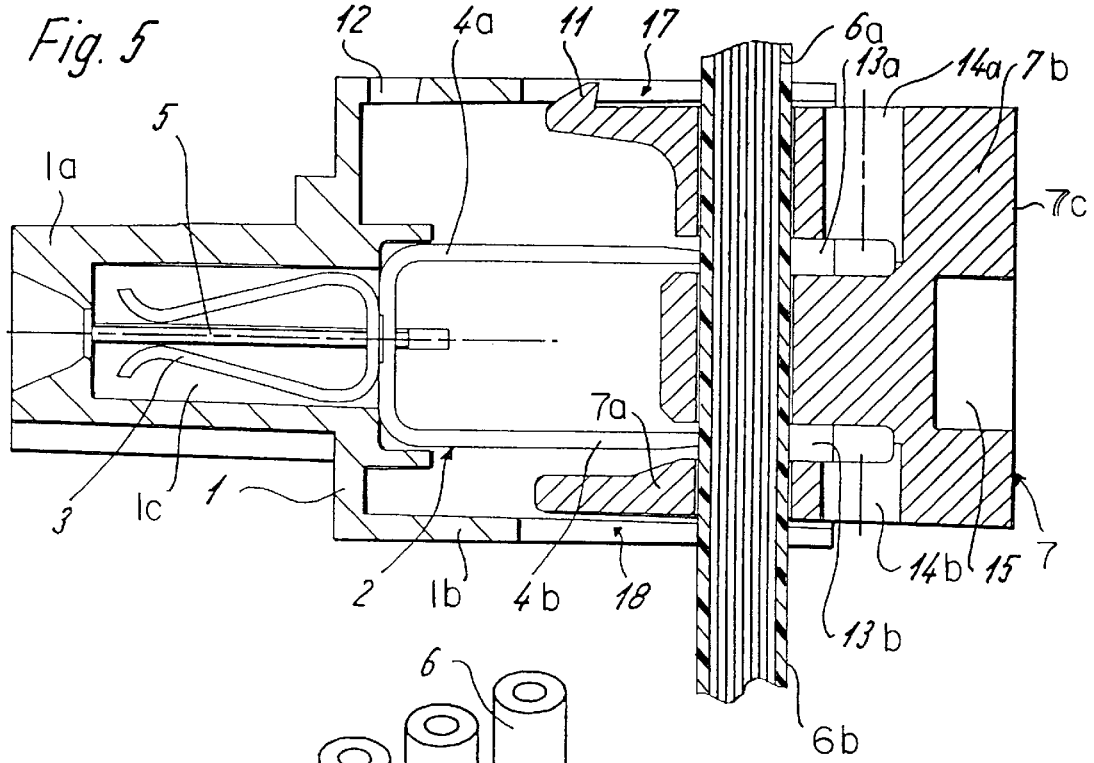
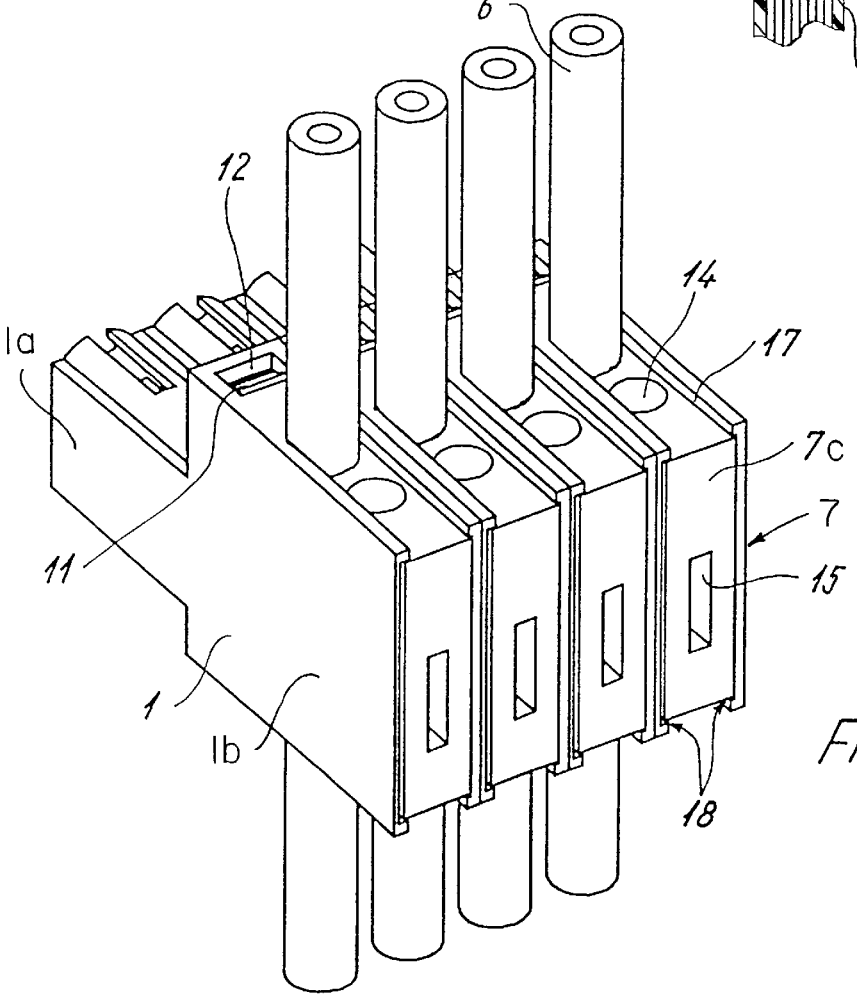
Fig. 6

ELECTRICAL CONNECTOR ASSEMBLY INCLUDING INSULATION PIERCING PLUG-IN MEANS

BACKGROUND OF THE INVENTION

1. Field of the Invention

This invention relates to an electrical connector assembly including insulation-piercing means that afford simple electrical connection of the connector assembly to an insulated wire conductor at any desired intermediate location thereon.

2. Brief Description of the Prior Art

It is well known in the prior art to provide electrical connector assemblies having a single-pole or a multi-pole housing consisting of electrical insulating material and containing an electrical contact having a cutting edge for penetrating the insulation of a wire to effect electrical contact with the conductor therein, which wire is introduced into the housing by means of an insertable wire support member. For example, in the German Patent No. DE 196 28 116 C 1, the housing contains an opening for receiving the insulated electrical conductor, and, on the other side of the housing, there is provided a housing portion that acts as a stop which limits the extent of insertion of the insulated conductor. The conductor support member contains enclosed boreholes for passing the end of the conductor therethrough.

These known plug-type electrical connectors are not suitable for use in bus conductor systems in which electrical potential tapped connections often occur at varying positions, since in this type of connector, the electrical conductor must normally be separated intermediate its ends.

Accordingly, the connector assembly of the present invention was developed to provide a plug connector that functions in a simple manner as an insulations-penetrating connector for use with bus conductors.

SUMMARY OF THE INVENTION

A primary object of the present invention is to provide a connector of the insulation-penetrating type that may be connected to an insulated conductor at any desired location intermediate its ends, use being made of a connector housing formed of insulating material and containing at one end a slot in which is mounted a contact having an insulation-piercing cutting edge, together with a wire support member that is insertable at one end into the housing slot, said wire support member having a lateral surface containing a groove that receives the insulated wire. Thus, when the end of the wire support member is inserted into the housing slot, the contact cutting edge pierces the insulation and comes into electrical engagement with the conductor at the desired location on the wire.

Another object of the invention is to form the groove in the lateral surface of the insertable wire support member with an entrance mouth opening having a transverse dimension that is slightly smaller than the outside diameter of the insulated wire, thereby to retain the wire in the groove during the insertion of the support member end into the housing slot.

According to a more specific object of the invention, the electrical contact has at its forward end a generally tulip-shaped jack contact that extends into the longitudinal through bore contained in the forward end of the housing, thereby to mount the contact in the housing. The inner wall surface of the through bore is provided with a longitudinal rib that further assists in mounting the contact member in the housing.

BRIEF DESCRIPTION OF THE DRAWING

Other objects and advantages of the invention will become apparent from a study of the following specification when viewed in the light of the accompanying drawing, in which:

FIG. 5 is a longitudinal sectional view of the connector assembly with the wire support member in a partially inserted condition;

FIG. 6 is a rear perspective view of the multi-pose assembly of FIG. 4 with the wire support members in their fully inserted conditions.

DETAILED DESCRIPTION

Figure 1:
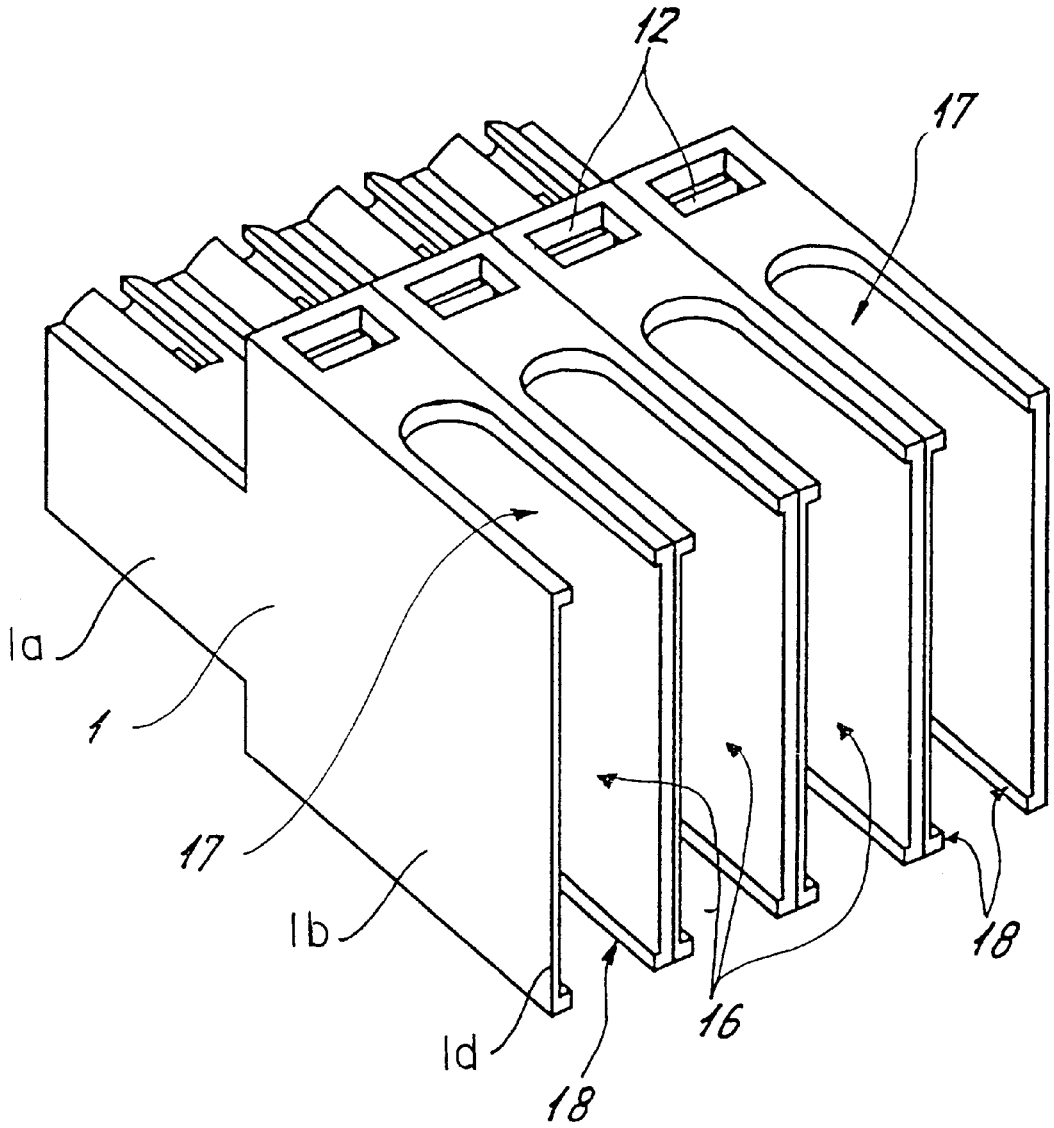
FIG. 1 is a rear perspective view of the connector main housing.

Referring first more particularly to FIG. 1, the multi-pole connector assembly includes a plurality of oblong connector main housings 1 each formed from a suitable electrically insulating synthetic plastic material and having a generally rectangular horizontal cross-sectional configuration. Each housing has forward and rear ends 1*a* and 1*b*, the housing forward end 1*a* containing a longitudinal through bore 1*c* (FIGS. 2 and 5), and a rear end 1*b* that contains a chamber 1*d* communicating with said longitudinal bore, and a vertical slot 16. Opposed pairs of upper and lower guide shoulders or ribs 17 and 18 are provided at the upper and lower edges of the side walls of the slots 16. The top wall of the chamber 1*d* contains a locking opening 12.

Figure 2:
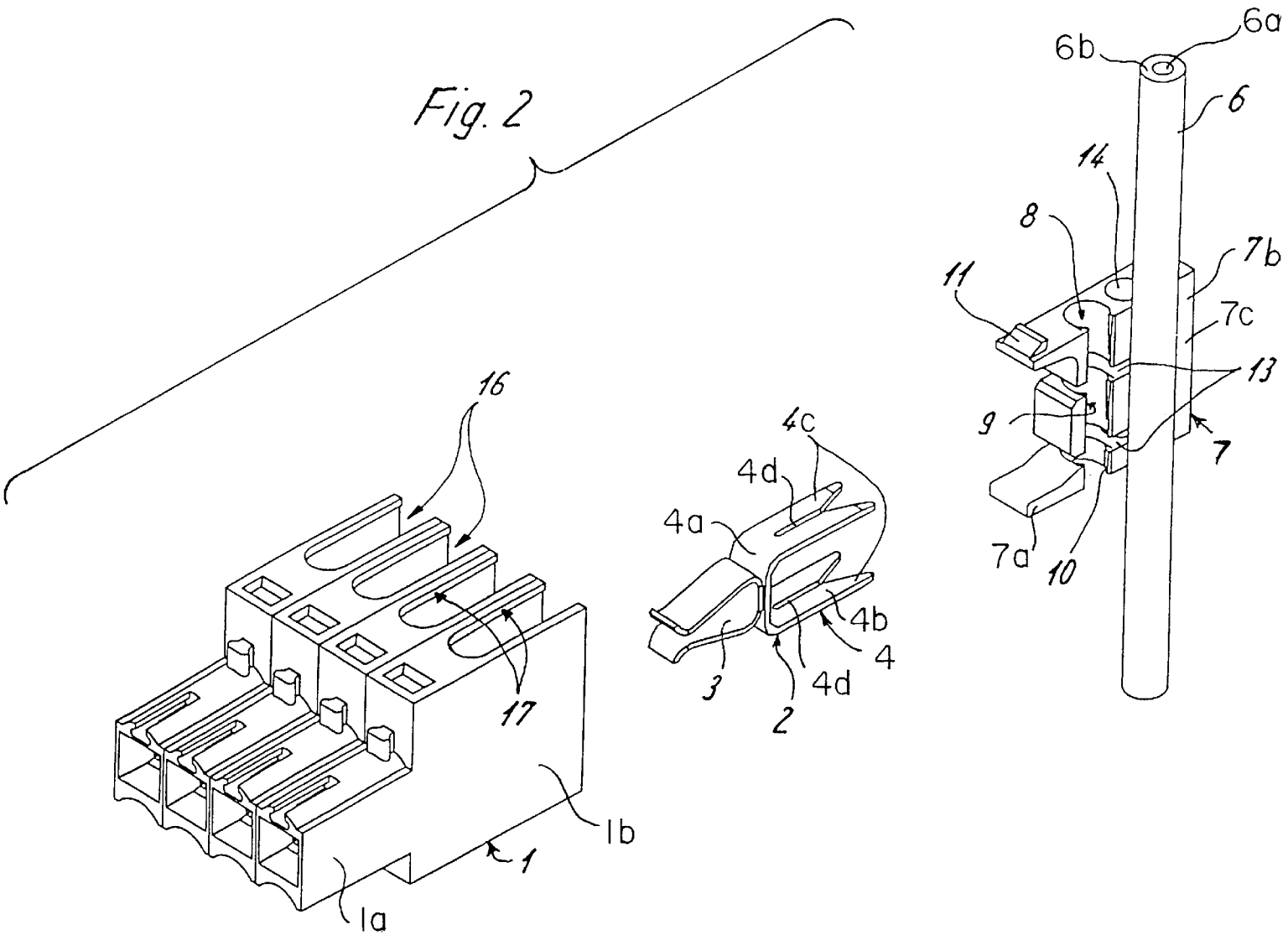
FIG. 2 is an exploded view of the connector assembly.
Figure 7:
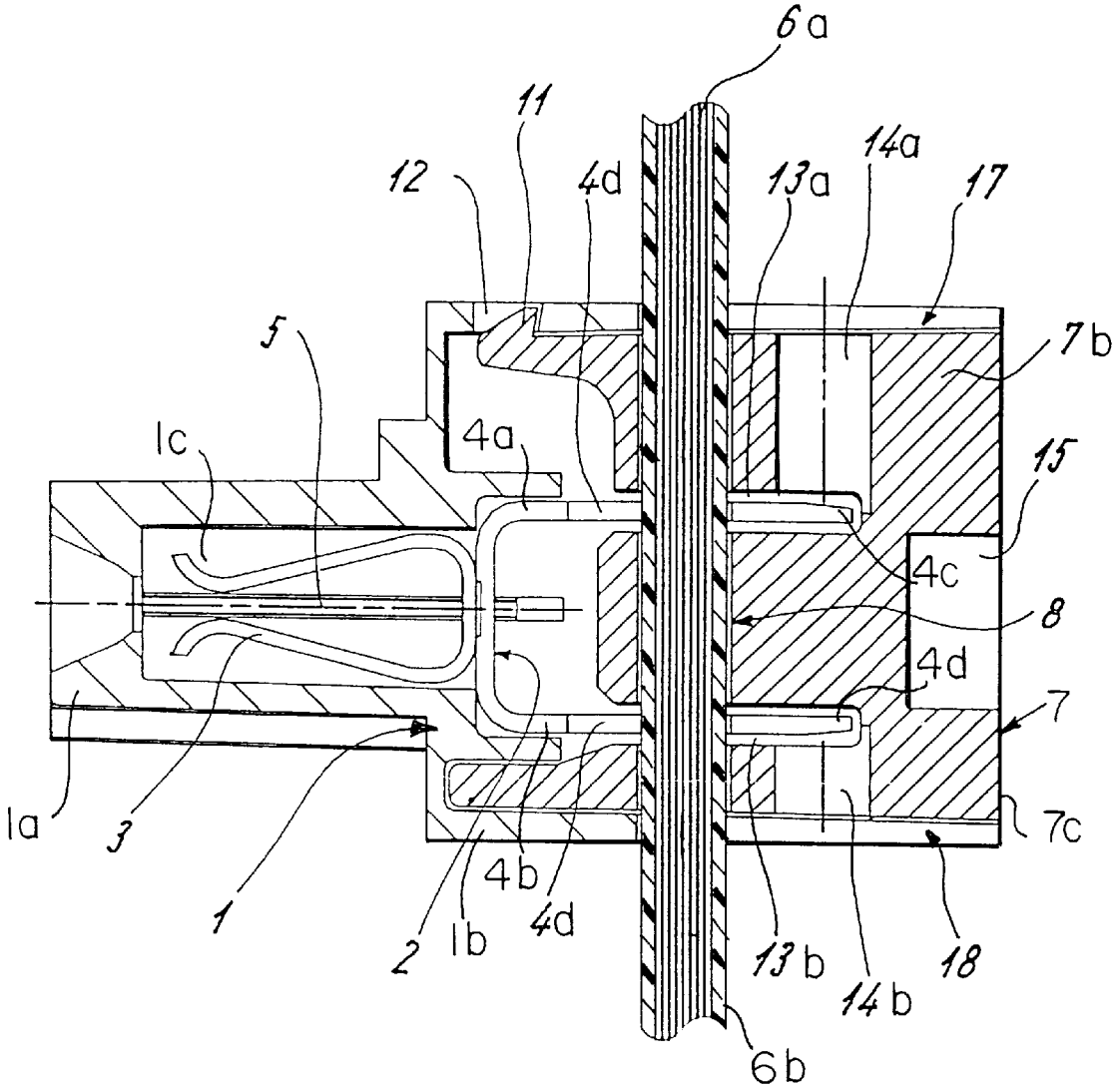
FIG. 7 is a longitudinal sectional view corresponding to FIG. 5 with the wire support member in its fully inserted condition.

Referring to FIG. 2, within each housing is mounted a self-piercing electrical contact member 2 formed of metal and including at its rear end a U-shaped portion defining a pair of vertically spaced rearwardly facing arm portions 4*a* and 4*b* each containing in its rear extremity a V-shaped notch provided with cutting knife edges 4*c*, and a longitudinal forwardly-extending slot 4*d*. At its forward end, the electrical contact 2 carries a generally tulip-shaped jack contact portion 3 that extends within the longitudinal bore 1*c*, as shown in FIG. 5. A longitudinal internal rib 5 provided on the wall of bore 1*c* assists in the mounting and stabilization of the contact 2 in the bore, as shown in FIGS. 5 and 7. The forward and rear contact portions 3 and 4 of contact 2 are rigidly connected together, for example, by riveting or welding. Associated with each housing is a conductor support member 7 formed of suitable electrically insulating synthetic plastic material and having forward and rear end portions 7*a* and 7*b*, said support member being adapted for insertion at its forward end 7*a* into the slot 16 contained in the rear end of the associated housing 1. The lateral surface 7*c* of the wire support member contains a vertical groove 8 for receiving an insulated wire 6 including a conductor 6*a* enclosed by an annular layer of electrical insulating material 6*b*. The groove 8 has a circular cross-sectional configuration with a diameter at least as great as that of the outer diameter of the wire 6, the groove having an entrance mouth opening 9 with a width that is slightly less than the outer diameter of the wire, thereby to retain the wire in the groove. Preferably, the edges 10 of the mouth opening 9 are chamfered. The wire support member 7 also contains at its forward end 7*a* a pair of vertically spaced horizontal slots 13*a* and 13*b* for receiving the contact cutting arms 4*a* and 4*b*, respectively, vertical probe openings 14*a* and 14*b* communicating with these horizontal slots, respectively, and a latch projection 11 that extends upwardly for locking engagement with a corresponding locking opening 12 contained in the upper wall of the housing rear portion 1*a*, as shown in FIG. 7. The rear end wall surface 7*c* of the wire support member 7 contains a tool receiving recess 15.

Figure 4:
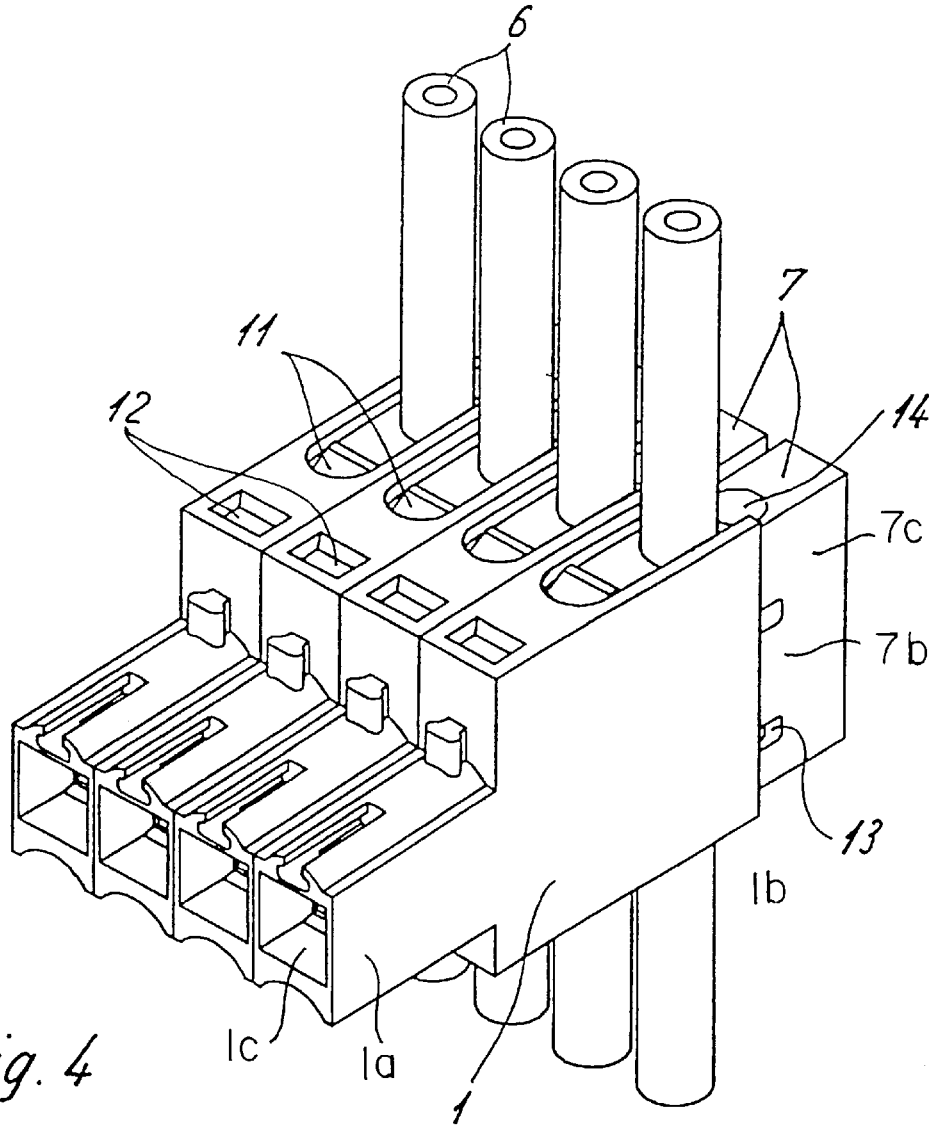
FIG. 4 is a front perspective view of the complete multi-pole connector assembly with the wire support members in partially inserted conditions.

Referring now to FIGS. 4 and 5, after the wire support member 7 is connected at any desired location longitudinally of the insulated wire 6, and with the wire being retained within the lateral groove 8 by the tight fit afforded by the reduced width dimension of the entrance mouth opening 9, the wire support member is progressively inserted at its forward end 7*a* into the slot 16 with the cutting arms 4*a* and 4*b* of the contact 2 being received within the horizontal slots 13*a* and 13*b*, respectively, contained in the forward end of the wire support member 7, and with the latch member 11 being resiliently inwardly compressed. The guide shoulders 17 and 18 at the top and bottom of the slot 16 guide the wire support member during its insertion within the slot 16. As the wire support member 7 is progressively introduced into the slot 16 toward the fully inserted position shown in FIG. 7, the cutting knife edges 4*c* of the contact arms penetrate or pierce the insulation layer 6*b* of the wire and come into electrical engagement with the inner conductor 6*a* of the wire 6, whereupon the conductor is progressively introduced into and retained within the slots 4*d*. In order to assist in this insertion of the wire support member into the slot 16 and the associated penetration of the insulation layer 6*b* by the knife edges 4*c*, the tip of a hand tool such as a screw driver may be introduced into the recess 15 contained in the rear surface 7*c* of the wire support member, thereby to permit a forwardly directed force to be applied to the wire support member. After the wire support member 7 has been inserted to the fully inserted position of FIG. 7, the latch 11 resiliently springs outwardly into locking engagement with opening 12, thereby to connect the wire support member with the connector main housing 1.

Figure 3:
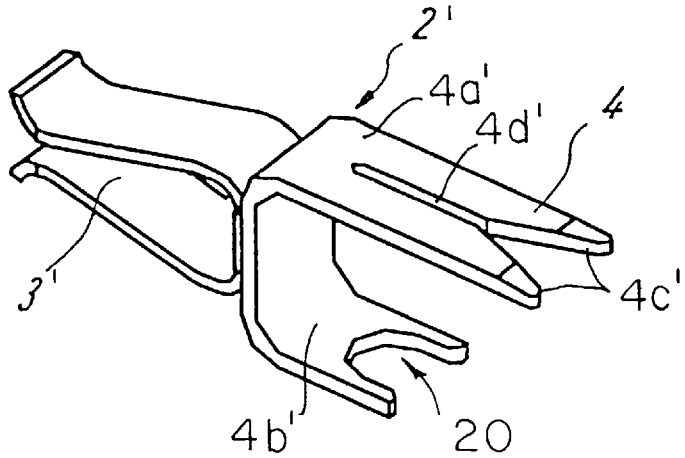
FIG. 3 is a rear perspective view of the electrical contact.

In the modification shown in FIG. 3, instead of providing cutting knife edges on both arms of the rear cutting end of the electrical contact, in the situation where the conductor is design to carry only a relatively low level of current, the lower arm 4*b*' of the contact 2' is provided with a groove 20 the width of which is greater than the wire outer diameter, whereby the insulation of the wire is penetrated only by the single pair of knife cutting edges 4*c*' carried by the upper contact arm 4*d*'. Consequently, in this embodiment, which is useful when only a small level of current is carried by the insulated wire, the resistance to the introduction of the wire support member into the slot 16 is reduced by one-half.

While in accordance with the provisions of the Patent Statutes the preferred forms and embodiments of the invention have been illustrated and described, it will be apparent to those skilled in the art that changes may be made without deviating from the inventive concepts set forth above.

What is claimed is:

1. An insulation-piercing electrical connector assembly adapted for connection with an intermediate portion of an insulated wire (6) having a conductor (6*a*) covered by an annular layer of insulating material (6*b*), comprising:

(a) a housing (1) formed of insulating material and having a generally oblong horizontal cross-sectional configuration defining housing forward (1*a*) and rear (1*b*) ? end portions, said rear housing end portion having an end surface containing a vertical through slot (16), the forward end of said housing containing a through bore (1*c*) connected with said slot, the width of said slot being greater than the diameter of the wire;

(b) an electrical contact member (2) mounted in said slot opposite said through bore, said electrical contact member having at its rear end at least one generally horizontal insulation-piercing cutting edge (4*a*) facing rearwardly toward the rear end of said slot; and (c) an oblong wire support member (7) having forward (7*a*) and rear (7*b*) end portions, said support member forward end portion having cross-sectioned dimensions that are less than the corresponding dimensions of said slot, thereby to permit insertion of said support member forward portion within said slot, said support member forward end portion having a lateral face (7*c*) containing a vertical groove (8) for laterally receiving the conductor, said cutting edge being so arranged in said slot that when said support member forward end portion is progressively inserted forwardly within said slot, said wire will extend through said slot and said cutting edge will pierce the insulation layer of the wire and come into electrical contact with an intermediate portion of the wire conductor.

2. A connector assembly as defined in claim 1, wherein the groove has a generally circular cross-sectional configuration and an entrance mouth (9) having a width that is slightly less than the diameter of the wire insulation layer, thereby to retain the wire in said groove.

3. A connector assembly as defined in claim 2, wherein the edges of the slot entrance opening have chamfered surfaces (10).

4. A connector assembly as defined in claim 1, wherein electrical contact member includes at its forward end a generally tulip-shaped female jack contact (3) mounted in said housing and extending within said longitudinal through bore.

5. A connector assembly as defined in claim 4, wherein the side wall of said housing longitudinal bore includes a longitudinal support rib (5) which cooperates with said the forward end of said electrical contact member to mount said electrical contact member within said bore.

6. A connector assembly as defined in claim 1, wherein the rear end portion of said electrical contact member includes a second horizontal cutting edge (4*b*) extending parallel with and vertically spaced from said one cutting edge, whereby the conductor insulation is penetrated at two locations.

7. A connector assembly as defined in claim 1, wherein the rear end portion of said contact member is generally U-shaped and includes a pair of vertically spaced horizontal arms, one of said arms containing an opening having transverse dimension that is greater than the outer diameter of the insulated wire, said opening being arranged to receive said wire in concentrically spaced relation, whereby the insulation layer is penetrated by only said one cutting edge.

8. A connector assembly as defined in claim 1, and further wherein the rear end face of said wire support member contains a recess (15) for receiving an associated tip of a manual insertion tool.

9. An insulation-piercing electrical connector assembly adapted for connection with an intermediate portion of an insulated wire (6) having a conductor (6*a*) covered by an annular layer of insulating material (6*b*), comprising:

(a) a housing (1) formed of insulating material and having a generally oblong horizontal cross-sectional configuration defining housing forward (1*a*) and rear (1*b*) end portions, said rear housing end portion having an end surface containing a vertical through slot (16), the forward end of said housing containing a through bore (1*c*) connected with said slot, the width of said slot being greater than the diameter of the wire;

(b) an electrical contact member (2) mounted in said slot opposite said through bore, said electrical contact member having at its rear end at least one generally horizontal insulation-piercing cutting edge (4*a*) facing rearwardly toward the rear end of said slot; and (c) an oblong wire support member (7) having forward (7*a*) and rear (7*b*) end portions, said support member forward end portion having cross-sectioned dimensions that are less than the corresponding dimensions of said slot, thereby to permit insertion of said support member forward portion within said slot, said support member forward end portion having a lateral face (7*c*) containing a vertical groove (8) for laterally receiving the conductor, and a forward end face containing opposite each cutting edge of said electrical contact member a horizontal recess (13), said cutting edge being so arranged in said slot that when said support member forward end portion is progressively inserted forwardly within said slot, said wire will extend through said slot and said cutting edge will successively extend within said recess, pierce the insulation layer of the wire, and come into electrical contact with an intermediate portion of the wire conductor.

10. A connector assembly as defined in claim 9, wherein the upper and lower edges of the side walls of said slot are provided with opposed pairs of inwardly directed horizontal guide ribs (17,18) for guiding said forward end of said wire support member during the insertion thereof into said slot.

11. A connector assembly as defined in claim 9, and further wherein said connector body contains intermediate its ends a vertical probe access opening (14) opposite each said insulation-piercing cutting edge.

12. A connector assembly as defined in claim 9, and further wherein said wire support member includes at its forward end at least one external catch hook (11) that cooperates with a corresponding recess (12) in said housing to fasten said support member in said slot.

* * * * *